US008572788B2

(12) United States Patent
Kurek

(10) Patent No.: US 8,572,788 B2
(45) Date of Patent: Nov. 5, 2013

(54) CONCRETE DIAPHRAGM INCLUDING FORM SPANNING BETWEEN SPACED-APART LONGITUDINAL MEMBERS

(76) Inventor: Nathan A. Kurek, Latrobe, PA (US)

( * ) Notice: Subject to any disclaimer, the term of this patent is extended or adjusted under 35 U.S.C. 154(b) by 587 days.

(21) Appl. No.: 12/774,096

(22) Filed: May 5, 2010

(65) Prior Publication Data

US 2011/0271636 A1 Nov. 10, 2011

(51) Int. Cl.

| | |
|---|---|
| ***E01D 19/12*** | (2006.01) |
| ***E04B 1/21*** | (2006.01) |
| ***E04B 1/30*** | (2006.01) |
| *E01D 2/02* | (2006.01) |

(52) U.S. Cl.

CPC . *E01D 19/12* (2013.01); *E01D 2/02* (2013.01); *E04B 1/215* (2013.01); *E04B 1/30* (2013.01)

USPC ..... 14/73; 52/258

(58) Field of Classification Search

USPC ..... 14/6, 73, 74.5, 77.1; 52/250, 251, 252, 52/258, 259

See application file for complete search history.

(56) References Cited

U.S. PATENT DOCUMENTS

| | | | | | |
|---|---|---|---|---|---|
| 957,414 | A | * | 5/1910 | Fisher | 249/26 |
| 973,814 | A | * | 10/1910 | Robinson | 52/252 |
| 973,815 | A | * | 10/1910 | Robinson | 52/834 |
| 992,739 | A | * | 5/1911 | Meier | 52/252 |
| 1,011,195 | A | * | 12/1911 | Harry | 52/252 |
| 1,088,676 | A | * | 3/1914 | Anderson | 52/250 |
| 1,119,969 | A | * | 12/1914 | Longevin | 249/26 |
| 1,135,721 | A | * | 4/1915 | Robinson | 264/34 |
| 1,717,546 | A | * | 6/1929 | Bemis | 52/259 |
| 1,794,079 | A | * | 2/1931 | Kellett | 52/252 |
| 3,562,979 | A | * | 2/1971 | Ali-Oglu | 52/125.5 |
| 3,792,830 | A | * | 2/1974 | Dashew et al. | 249/28 |
| 4,081,935 | A | * | 4/1978 | Wise | 52/236.8 |
| 4,125,973 | A | * | 11/1978 | Lendrihas | 249/188 |
| 4,333,285 | A | * | 6/1982 | Koizumi et al. | 52/252 |
| 4,363,200 | A | * | 12/1982 | Goldenberg | 52/251 |
| 4,409,764 | A | * | 10/1983 | Wilnau | 52/127.3 |
| 5,050,358 | A | * | 9/1991 | Vladislavic | 52/334 |
| 5,459,967 | A | * | 10/1995 | Bodtker | 52/93.1 |
| 5,566,518 | A | | 10/1996 | Martin et al. | |

(Continued)

OTHER PUBLICATIONS

Todd A. Helwig, O. Ozgur Egilmez, and Charles A Jetann; Project 0-4145; Lateral Bracing of Bridge Girders by Permanent Metal Deck Forms; Austin, TX; Jan. 2005.

(Continued)

*Primary Examiner* — Michael Safavi

(74) *Attorney, Agent, or Firm* — James Ray & Assoc

(57) ABSTRACT

A form or a series of forms for forming the bridge diaphragm from concrete material includes one or more bottom walls having an inner surface thereof abutting a bottom surface of the diaphragm. There is at least a pair of side walls upstanding on the inner surface of the bottom wall or walls at a respective longitudinal edge thereof and has an inner surface thereof abutting a respective side surface of the diaphragm. The at least the pair of side walls define each of a generally open top and a generally hollow interior of the form. There is also means for securely attaching each end of the form or series of forms to one of a side surface of at least one of the pair of longitudinal members and an end of another form for forming the diaphragm from the concrete material. Bracing of upper edges is also provided.

16 Claims, 4 Drawing Sheets

(56) References Cited

U.S. PATENT DOCUMENTS

| | | | | |
|---|---|---|---|---|
| 5,678,375 | A * | 10/1997 | Juola | 52/655.1 |
| 6,345,403 | B1 | 2/2002 | Nagle | |
| 6,625,943 | B1 * | 9/2003 | Renner | 52/251 |
| 8,056,291 | B1 * | 11/2011 | diGirolamo et al. | 52/250 |
| 8,291,676 | B2 * | 10/2012 | Hong et al. | 52/745.13 |
| 2001/0003234 | A1 * | 6/2001 | Van Doren | 52/251 |

OTHER PUBLICATIONS

Alabama Department of Transportation; Bridge Construction; Second Edition Mar. 2008.

Dr. Arnold Azizinamini and Lynden Vander Veen, P.E.; Bridges Made Easy; Nov. 8, 2004.

Principal Investigators Douglas Nims; Nabil Grace; Evaluation of Stay-in-Place Metal Forms; Ohio Department of Transportation; May 2006.

* cited by examiner

CONCRETE DIAPHRAGM INCLUDING FORM SPANNING BETWEEN SPACED-APART LONGITUDINAL MEMBERS

FIELD OF THE INVENTION

The present invention relates, in general, to concrete and metal structures and, more particularly, this invention relates to concrete diaphragms spanning the distance between a pair of longitudinally oriented support beans in the concrete bridge structure and, yet particularly, the instant invention relates to a form, system and method for forming-in-place such concrete diaphragm.

STATEMENT REGARDING FEDERALLY SPONSORED RESEARCH AND DEVELOPMENT

N/A

REFERENCE TO SEQUENCE LISTING, A TABLE, OR A COMPUTER PROGRAM LISTING COMPACT DISC APPENDIX

N/A

BACKGROUND OF THE INVENTION

As is generally well known, end, intermediate and continuity diaphragms are cast-in-place between a pair of spaced apart longitudinal beams in bridges as well as other structures affording vehicle and/or pedestrian traffic. Wood material is utilized in the field to build a form structure or through into which the concrete is poured and is allowed to set. After the concrete has been set, the wood form is removed. However, the construction and tear-down of the wood form requires considerable filed time slowing bridge construction process and increasing labor costs.

Accordingly, prior to the conception and development of the instant invention, efforts have been made to reduce time required to provide diaphragms. U.S. Pat. No. 6,345,403 issued to Nagle discloses precast concrete diaphragm for placement between longitudinal beams of the bridge structure. Ends of the diaphragm are adapted with pockets to receive concrete for tight joints.

However, it has been determined that there is a further need for reducing bridge construction costs and duration.

SUMMARY OF THE INVENTION

The invention provides, in combination with a diaphragm spanning a transverse distance between a pair of spaced-apart longitudinal members employed in a construction of a structure affording vehicle or pedestrian traffic, a form for forming the diaphragm from concrete material. The form includes a bottom wall having an inner surface thereof abutting a bottom surface of the diaphragm. There is a pair of side walls. Each of the pair of side walls upstands on the inner surface of the bottom wall at a respective longitudinal edge thereof and has an inner surface thereof abutting a respective side surface of the diaphragm. The pair of sides define each of a generally open top and a generally hollow interior of the form. There is also means for securely attaching each end of the form to one of a side surface of at least one of the pair of longitudinal members and an end of another form for forming the diaphragm from the concrete material.

The invention also provides, in combination with a diaphragm spanning a transverse distance between a pair of spaced-apart longitudinal members employed in a construction of a structure affording vehicle or pedestrian traffic, a system for forming the diaphragm from a concrete material. The system includes one or more bottom walls having an inner surface thereof abutting a bottom surface of the diaphragm. The system further includes a first plurality of side walls upstanding in series on the inner surface of the bottom wall at one longitudinal edge thereof and having an inner surface thereof abutting one side surface of the diaphragm. There is also a second plurality of side walls upstanding in series on the inner surface of the bottom wall at an opposed longitudinal edge thereof and having an inner surface thereof abutting an opposed side surface of the diaphragm. The first and second pluralities of side walls define each of a generally open top and a generally hollow interior of the form. A first means is provided for securely attaching ends of any two adjacent side walls therebetween. A second means is provided for securely attaching each outer edge of each outermost side wall to a side surface of the one of the pair of longitudinal members.

The invention also provides a method for forming the diaphragm from concrete material by using the aforedescribed form or system of forms.

OBJECTS OF THE INVENTION

It is, therefore, one of the primary objects of the present invention to provide a form for forming diaphragm from a concrete material.

Another object of the present invention is to provide a form for forming diaphragm from a concrete material that can be easily and simply installed.

Yet another object of the present invention is to provide a form for forming diaphragm from a concrete material that remains in place after concrete material has been set.

A further object of the present invention is to provide a system for forming diaphragm from a concrete material that accommodates diaphragm of different sizes.

Yet a further object of the present invention is to provide a method of forming diaphragm from a concrete material utilizing the above referenced form or system.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE VARIOUS EMBODIMENTS OF THE INVENTION

Figure 1:
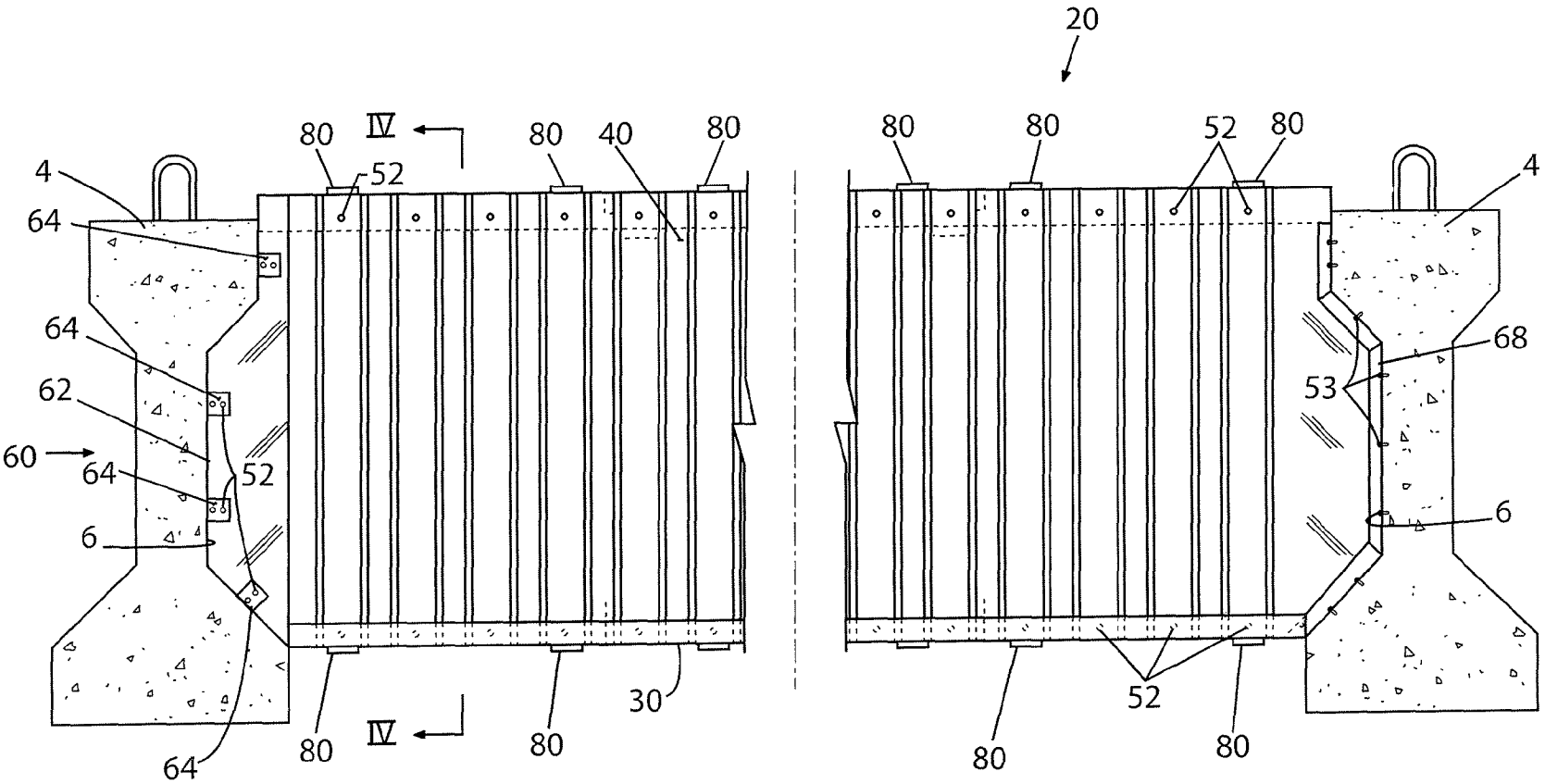
FIG. 1 is a side elevation view of a system for forming diaphragm from concrete material utilizing a single form.
Figure 2:
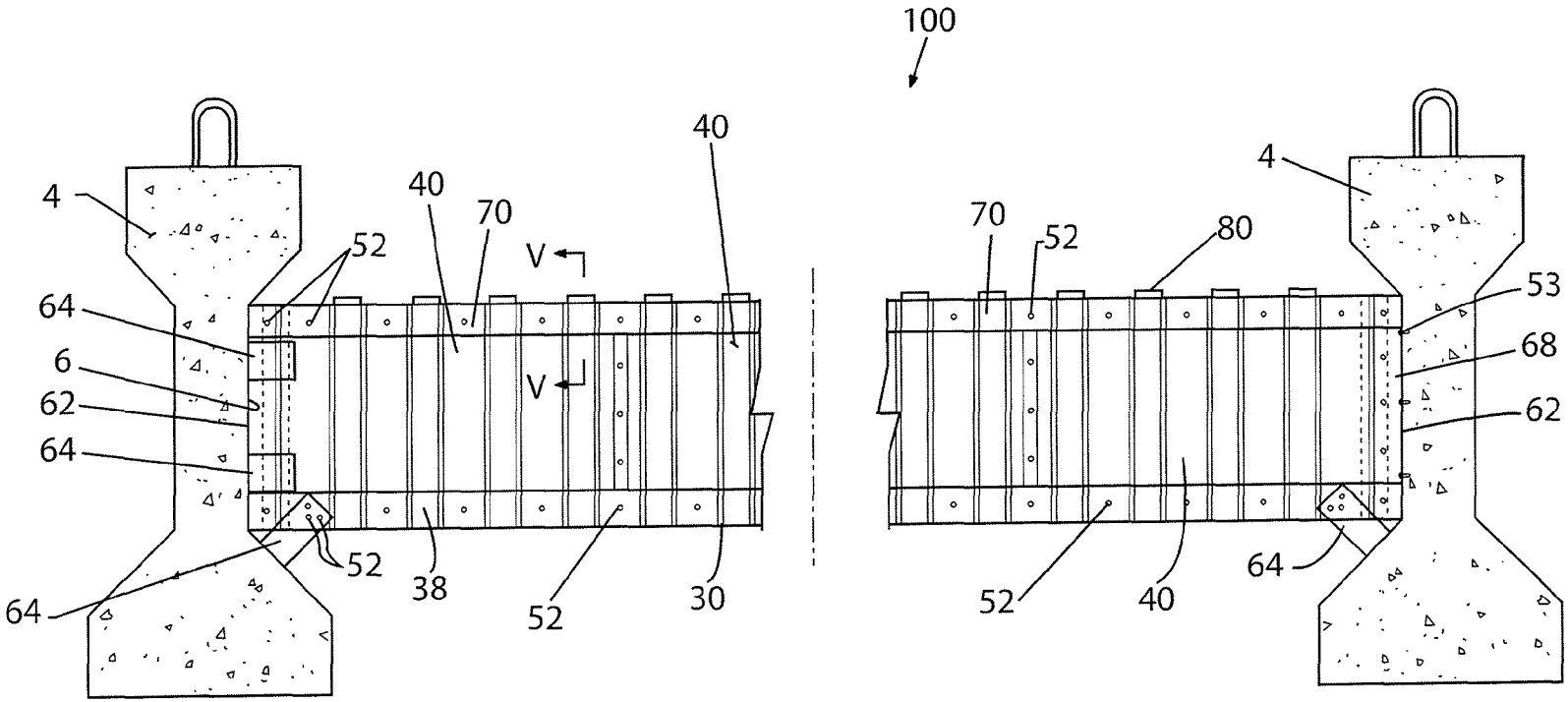
FIG. 2 is a side elevation view of a system for forming intermediate diaphragm from concrete material utilizing a plurality of forms.

Prior to proceeding to the more detailed description of the present invention, it should be noted that, for the sake of clarity and understanding, identical components which have identical functions have been identified with identical reference numerals throughout the several views illustrated in the drawing figures.

It is to be understood that the definition of a diaphragm applies to a bracing member manufactured from concrete material that spans the transverse distance between the main longitudinally oriented support beams or girders of a bridge or viaduct and assists in the distribution of loads.

The present invention is illustrated and described in combination with a bridge, although it will be apparent to those skilled in the relevant art that the present invention may be applied to other concrete or metal structures affording vehicle or pedestrian traffic and as such should not be interpreted as a limiting factor of the instant invention. For the sake of reference, such bridge may be of the type as disclosed in the U.S. Pat. No. 6,345,403 issued to Nagle wherein the support beams 14a through 14d are spaced apart from each other across the width of the bridge decking and are oriented in the longitudinal direction across the length of the bridge and wherein the conventional diaphragms that span the distance between the aforementioned support beams are labeled with numerals 18a through 18c and 20a through 20c and have a generally plate like shape. The teachings of U.S. Pat. No. 6,345,403 are incorporated into this document by reference thereto.

In the instant invention, the bridge structure is represented in various figures by a pair of longitudinal members, such as support beams 4, with the rest of the bridge structure omitted for the sake of brevity.

Reference is now made, to FIGS. 1-5, wherein there is shown a form, generally designated as 20, for forming-in-place diaphragm 10 from a concrete material. In particular reference to FIGS. 1 and 2, the form 20 includes a bottom wall 30 having a generally planar inner surface 32 thereof abutting a bottom surface 12 of the diaphragm 10. The form 20 also includes a pair of side walls 40 which are disposed in substantially vertical plane when the form 20 is installed for forming the diaphragm 10. Each of the pair of side walls 40 upstands on the inner surface 32 of the bottom wall 30 at a respective longitudinal edge 34, 36 thereof. Each of the pair of side walls 40 has an inner surface 42 thereof abutting a respective side surface 16 of the diaphragm 10. The side walls 40 define, in combination with the bottom wall 30, each of a generally open top 22 and a generally hollow interior 24 of the form 20 that is filled with concrete material that, when set, defines the diaphragm 10. In accordance with a presently preferred embodiment of the invention, each side wall 40 is manufactured from a corrugated metal. The term "corrugated" used here refers to the cross-sectional shape of the side wall 40 having alternating parallel grooves and ridges oriented preferably in a generally vertical direction when the form 20 is installed for forming the diaphragm 10. However, it is within the scope of the present invention to manufacture side walls 40 from other materials or combination of materials.

Furthermore, the bottom wall 30 may include a pair of upstanding longitudinal flanges 38, wherein an inner surface 39 of each flange 38 substantially abuts a bottom portion of outer surface 44 of a respective side wall 40.

When flanges 38 are provided, the form 20 includes means, generally designated as 50, for securing each longitudinal flange 38 to the respective side wall 40. Preferably, such means 50 includes pluralities of mechanical fasteners 52. In order to reduce labor costs associated with use of mechanical fasteners 52, such mechanical fasteners 52 are of a self-drilling type and, more specifically, that are commonly known as "TEK" self drilling screws. Although, it is within the scope of the present invention to secure longitudinal flange 38 to the respective side wall 40 by any other conventional means including welding, crimping, threaded fasteners in combination with matingly aligned through apertures and the like means.

There is also means, generally designated as 60, for securely attaching each end of the form 20 to one of a side surface 6 of at least one of the pair of longitudinal support beams 4 and an end of another form 20 for forming the diaphragm 10 from the concrete material, as it will be explained further in this document.

Such means 60 includes a predetermined contour of outer end edge 62 of each side wall 40 so as to position such outer end edge 62 of the form 20 in operative mating alignment with the side surface 6 of one of the pair of longitudinal support beams 4. The of outer end edge 62 may be either positioned either in abutting relationship with the side surface 6 or in close proximity thereto by way of a small clearance preventing leakage of liquid concrete material. Furthermore, the means 60 includes provisions for securely attaching the outer end edge 62 of the form 20 to the side 6 of the longitudinal support beam 4.

Such provisions may include at least a pair of brackets 64 secured to both the surface 6 of the longitudinal support beam 4 and the side wall 40 with, for example, mechanical fasteners that may be provided as self drilling fasteners 52. The brackets 64 may have an L-shaped or may have a portion thereof embedded into the longitudinal support beam 4 as it is being poured and set.

Such provisions may also include a flange 68 upstanding on the outer end edge 62 of each side wall 40 and generally abutting the side surface 6 of the longitudinal support beam 4 and mechanical fasteners 53 suitable for securing the flange 68 directly to the side surface 6 of the longitudinal support beam 4. The flange 68 may be L-shaped, having one leg thereof secured to the outer surface of the side wall 40 at the outer end edge 62 thereof.

It is also within the scope of the instant invention to reinforce and stiffen the open top end 22 of the form 20 by way of a pair of elongated L-shaped members 70, each having one leg 72 thereof disposed in a generally vertical plane abutting either inner or outer side surface of a respective side wall 40 and having another leg 74 thereof disposed in a generally horizontal plane either outwardly or inwardly relative to the side wall 40.

It is further contemplated to brace at least the top open end 22 with a brace or braces 80 disposed transversely to the direction of the elongated L-shaped members 70.

The diaphragm 10 may be formed with a single form 20 spanning the entire distance between the pair of longitudinal support beams 4 or a system, generally designated as 100, may be provided as containing a plurality of such forms 20 positioned in series with each other along the length of the diaphragm 10.

When the plurality of forms 20 are provided, the outer ends of the most outer forms 20 will be attached to respective side surfaces 6 of the longitudinal beam member 6. The inner ends of the most outer forms 20 as well as the ends of the inner forms 20 will be secured therebetween by way of the self drilling fasteners 52 or any other suitable means.

Figure 3:
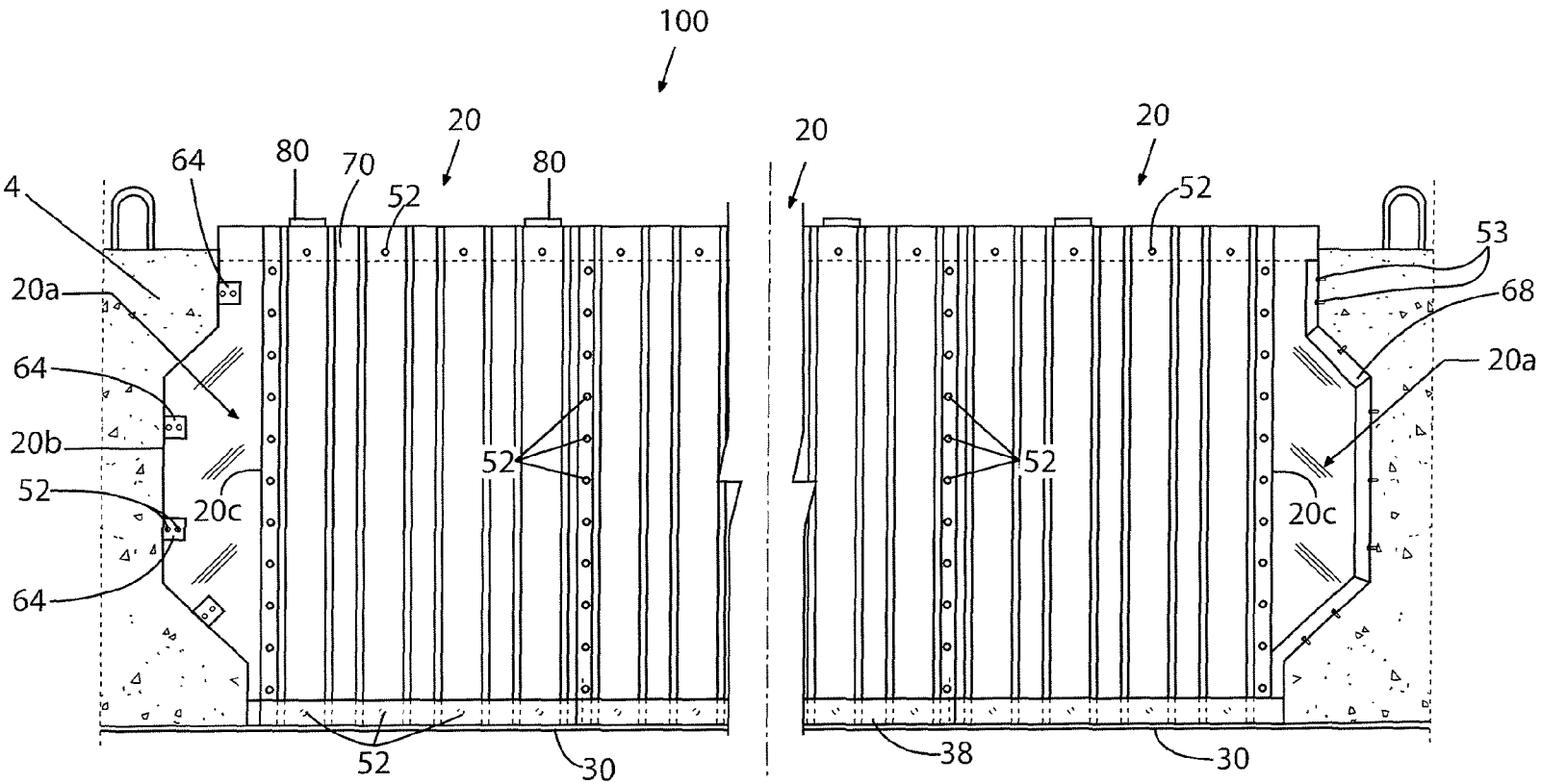
FIG. 3 is a side elevation view of a system for forming continuity diaphragm from concrete material utilizing a plurality of forms.
Figure 4:
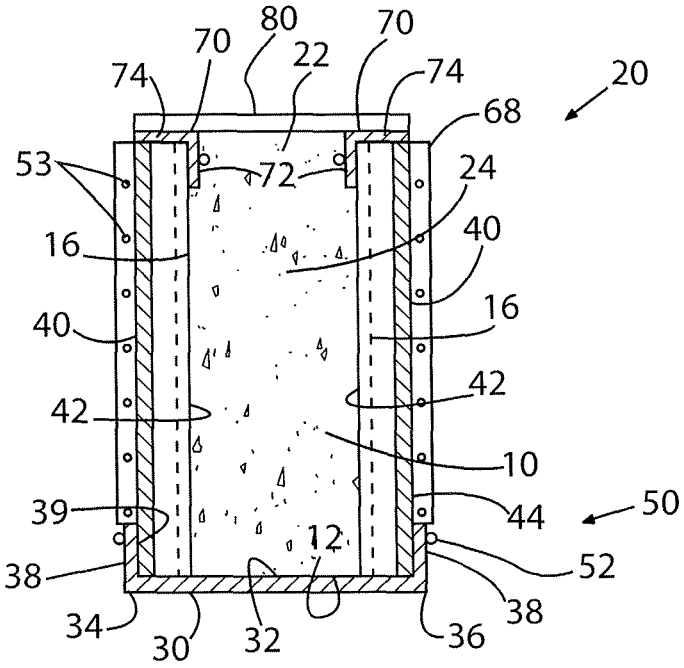
FIG. 4 is a cross-section view along lines IV-IV of the form of FIG. 1.
Figure 5:
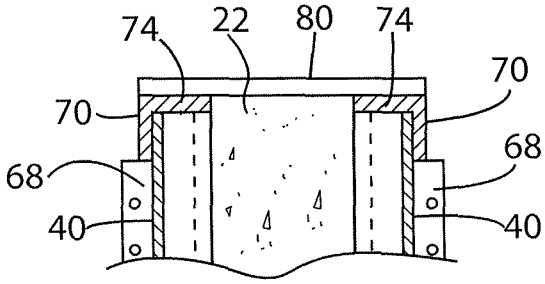
FIG. 5 is a partial cross-section view along lines V-V of the form of FIG. 2.

When the ends of the forms 20 must be contoured when forming diaphragm 10 for end application of FIG. 1 or continuity application of FIG. 3, it has been found advantageous for the sake of cost containment to provide end form sections 20*a* that has outer end 20*b* thereof contoured substantially identical to the shape or contour of the mating surface 6 of the longitudinal support beam 4 and has an opposed inner end 20*c* thereof being generally straight to operatively mate with generally straight end of the adjacent form 20 and, more particularly, the side wall 40, as best shown in FIG. 3.

When the plurality of forms 20 are provided, the length of each of the pair of angle shaped members 70 will be preferably substantially equal to a combined length of the plurality of forms 20 measured at the top edges thereof. In other words, the length of the elongated L-shaped members 70 is predetermined to substantially span the entire transverse distance between the opposed vertical surfaces 6 of the pair of longitudinal support beams 4.

Furthermore, it has been found advantageous to select the length of the bottom wall 30 to substantially span the entire transverse distance between the opposed vertical surfaces 6 of the pair of longitudinal support beams 4. In this arrangement, a first plurality of side walls 40 upstand in series on the bottom wall 30 at one longitudinal edge thereof and have a bottom edge thereof secured to the bottom wall 30, preferably at the longitudinal flange 36 by way of the fasteners 52. Furthermore, a second plurality of side walls 40 upstand in series on the bottom wall 30 at the opposed longitudinal edge thereof and have a bottom edge thereof also secured to the bottom wall 30, preferably at the longitudinal flange 36 by way of the fasteners 52. The first and second pluralities of the side walls 40 define, in combination with the bottom wall 30, the open top and the hollow interior of the system 100.

The general method of forming a diaphragm 10 from a concrete material includes the steps of providing one or plurality of forms 20 having a bottom wall 30 and at least a pair of side walls 40, each of the at least pair of side walls 40 upstanding on the inner surface 32 of the bottom wall 30 at a respective longitudinal edge thereof and defining each of a generally open top 22 and a generally hollow interior 24 of the one or the plurality of forms 20. Then, positioning one or plurality of forms 20 substantially transverse to a direction of the pair of spaced-apart longitudinal members 4 at a location preselected for receiving the diaphragm 10. Next, securing ends of the form 20 or outermost ends of the plurality of forms 20 to a respective inner vertical surface 6 of the pair of spaced-apart longitudinal support beams 4. Depositing concrete material in a liquid form into the one or plurality of forms 20. Finally, solidifying the concrete material deposited into the one or plurality of forms 20. The form or forms 20 remain attached to the diaphragm 10 during use thereof. The aforedescribed optional elongated L-shaped members 70 and braces 80 are added prior to depositing concrete material into the form or forms 20.

The form or forms 20 may be preassembled on the ground level (not shown) and hoisted into position to be occupied by the diaphragm 10 or may be erected in place.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

I claim:

1. In combination with a diaphragm spanning a transverse distance between a pair of spaced-apart longitudinal members employed in a construction of a structure affording vehicle or pedestrian traffic, a form for forming said diaphragm from concrete material, said form comprising:

(a) a bottom wall having an inner surface thereof abuttingly engageable with a bottom surface of said diaphragm;

(b) a pair of side walls, each of said pair of side walls upstanding on said inner surface of said bottom wall at a respective longitudinal edge thereof, said each of said pair of side walls having an inner surface thereof abutting a respective side surface of said diaphragm and defining each of a generally open top and a generally hollow interior of said form;

(c) a predetermined contour of one end edge of said each side wall so as to position said one end edge of said form in operative mating alignment with a contour of a side surface of one of said pair of longitudinal members;

(d) at least a pair of L-shaped brackets, each of said at least pair of L-shaped brackets having a first leg thereof secured to said side surface of said one of said pair of longitudinal members and having an opposed second leg thereof generally abutting exterior or interior surface portion of a respective side wall; and (e) mechanical fasteners securing said opposed second leg of said each bracket to said exterior or interior surface portion of said respective side wall.

2. In combination with a diaphragm spanning a transverse distance between a pair of spaced-apart longitudinal members employed in a construction of a structure affording vehicle or pedestrian traffic, a form for forming said diaphragm from concrete material, said form comprising:

(a) a bottom wall having a pair of upstanding longitudinal flanges and an inner surface thereof abuttingly engageable with a bottom surface of said diaphragm;

(b) a pair of side walls, each of said pair of side walls upstanding on said inner surface of said bottom wall at a respective longitudinal edge thereof, said each of said pair of side walls having an inner surface thereof abutting a respective side surface of said diaphragm and defining each of a generally open top and a generally hollow interior of said form; and (c) means for securely attaching each end of said form to one of a side surface of at least one of said pair of longitudinal members and an end of another form for forming said diaphragm from said concrete material.

3. The form, according to claim 2, wherein an inner surface of each flange substantially abuts an outer surface portion of a respective side wall.

4. The form, according to claim 2, wherein said form includes means for securing each longitudinal flange to said respective side wall.

5. The form, according to claim 4, wherein said means for securing said each longitudinal flange to said respective side wall includes pluralities of mechanical fasteners.

6. The form, according to claim 2, wherein at least one of said pair of side walls is manufactured from corrugated metal.

7. The form, according to claim 2, wherein said means includes:

(a) a predetermined contour of one end edge of said each side wall so as to position said one end edge of said form in operative mating alignment with a contour of a side surface of one of said pair of longitudinal members;

(b) at least a pair of L-shaped brackets, each of said at least pair of L-shaped brackets having a first leg thereof secured to said side surface of said one of said pair of longitudinal members and having an opposed second leg thereof generally abutting exterior or interior surface portion of a respective side wall; and (c) mechanical fasteners securing said opposed second leg of said each bracket to said exterior or interior surface portion of said respective side wall.

8. The form, according to claim 2, wherein said means includes:

(a) a predetermined contour of one end edge of said each side wall so as to position said one end edge of said form in operative mating alignment with a contour of a side surface of one of said pair of longitudinal members;

(b) a flange upstanding on said end edge of said each side wall and generally abutting said side surface of said one of said pair of longitudinal members; and (c) mechanical fasteners securing said flange to said side surface of said of one of said pair of longitudinal members.

9. In combination with a diaphragm spanning a transverse distance between a pair of spaced-apart longitudinal members employed in a construction of a structure affording vehicle or pedestrian traffic, a system for forming said diaphragm from a concrete material, said system comprising:

(a) a plurality of forms positioned in series with each other along a length of said diaphragm, each of said plurality of forms including:

i. a bottom wall having a pair of upstanding longitudinal flanges and an inner surface thereof abuttingly engageable with a bottom surface of said diaphragm, and ii. a pair of side walls, each of said pair of side walls upstanding on said inner surface of said bottom wall at a respective longitudinal edge thereof, said each of said pair of side walls having an inner surface thereof abutting a respective side surface of said diaphragm and defining each of a generally open top and a generally hollow interior of said each form; and (b) means for securely attaching each end of each of said plurality of forms to one of a side surface of said one of said pair of longitudinal members and an end of another form.

10. The system, according to claim 9, wherein said system includes a pair of angles, each of said pair of angles secured to a respective side wall of said each form, wherein a length of said each of said pair of angles is substantially equal to a combined length of said plurality of forms measured at said top edges thereof.

11. In combination with a diaphragm spanning a transverse distance between a pair of spaced-apart horizontally disposed longitudinal members employed in a construction of a structure affording vehicle or pedestrian traffic, a system for forming said diaphragm from a concrete material, said system comprising:

(a) a bottom wall having an inner surface thereof abuttingly engageable with a bottom surface of said diaphragm;

(b) a first plurality of side walls, each of said first plurality of side walls upstanding in series on said inner surface of said bottom wall at one longitudinal edge thereof, said each of said first plurality of side walls having an inner surface thereof abutting one side surface of said diaphragm;

(c) a second plurality of side walls, each of said second plurality of side walls upstanding in series on said inner surface of said bottom wall at an opposed longitudinal edge thereof, said each of said second plurality of side walls having an inner surface thereof abutting an opposed side surface of said diaphragm, wherein said first and second pluralities of side walls define each of a generally open top and a generally hollow interior of said form;

(d) a first means for securely attaching ends of any two adjacent side walls therebetween; and (e) a second means for securely attaching each outer edge of each outermost side wall to a vertically disposed side surface of a respective one of said pair of longitudinal members.

12. The system, according to claim 11, wherein said system includes a pair of elongated L-shaped members, each of said pair of elongated L-shaped members secured to top edges of a respective one of first and second pluralities of side walls, wherein a length of said each of said pair of elongated L-shaped members is substantially equal to a combined length of said plurality of side walls measured at said top edges thereof.

13. The system, according to claim 12, wherein said system further includes at least one brace having a first end thereof securely attached to one of said pair of elongated L-shaped members and an opposed end thereof securely attached to an opposed of said pair of elongated L-shaped members.

14. The system, according to claim 11, wherein said second means includes:

(a) a predetermined contour of said outer edge of said each outermost side wall so as to position said outer edge of said each outermost side wall in operative alignment with a contour of a side surface of one of said pair of longitudinal members;

(b) a flange upstanding on said outer edge of said each outermost side wall and generally abutting said side surface of said one of said pair of longitudinal members; and (c) mechanical fasteners securing said flange to said side surface of said of one of said pair of longitudinal members.

15. The system, according to claim 11, wherein said second means includes:

(a) a predetermined contour of said outer edge of said each outermost side wall so as to position said outer edge of said each outermost side wall in operative alignment with a contour of a side surface of one of said pair of longitudinal members;

(b) at least a pair of L-shaped brackets, each of said at least pair of L-shaped brackets having a first leg thereof secured to said side surface of said one of said pair of longitudinal members and having an opposed second leg thereof generally abutting exterior or interior surface portion of a respective outermost side wall; and (c) mechanical fasteners securing said flange to said side surface of said of one of said pair of longitudinal members.

16. In combination with a diaphragm spanning a transverse distance between a pair of spaced-apart longitudinal members employed in a construction of a structure affording vehicle or pedestrian traffic, a system for forming said diaphragm from a concrete material, said system comprising:

(a) a bottom wall having an inner surface thereof abuttingly engageable with a bottom surface of said diaphragm;

(b) a first plurality of side walls, each of said first plurality of side walls upstanding in series on said inner surface of said bottom wall at one longitudinal edge thereof, said each of said first plurality of side walls having an inner surface thereof abutting one side surface of said diaphragm;

(c) a second plurality of side walls, each of said second plurality of side walls upstanding in series on said inner surface of said bottom wall at an opposed longitudinal edge thereof, said each of said second plurality of side walls having an inner surface thereof abutting an opposed side surface of said diaphragm, wherein said first and second pluralities of side walls define each of a generally open top and a generally hollow interior of said form;

(d) a first means for securely attaching ends of any two adjacent side walls therebetween; and (e) a second means for securely attaching each outer edge of each outermost side wall to a side surface of said one of said pair of longitudinal members, wherein said second means includes:

i. a predetermined contour of said outer edge of said each outermost side wall so as to position said outer edge of said each outermost side wall in operative alignment with a contour of a side surface of one of said pair of longitudinal members, ii. at least a pair of L-shaped brackets, each of said at least pair of L-shaped brackets having a first leg thereof secured to said side surface of said one of said pair of longitudinal members and having an opposed second leg thereof generally abutting exterior or interior surface portion of a respective outermost side wall, and iii. mechanical fasteners securing said flange to said side surface of said of one of said pair of longitudinal members.

* * * * *